US005950836A

United States Patent [19]

Iwamoto et al.

[11] Patent Number: 5,950,836

[45] Date of Patent: Sep. 14, 1999

[54] CONTAINER

[75] Inventors: Kenji Iwamoto; Kazuo Fujimoto; Hiroshi Nakatsui, all of Tokyo, Japan

[73] Assignee: Zeon Kasei Co., Ltd., Tokyo, Japan

[21] Appl. No.: 08/993,706

[22] Filed: Dec. 18, 1997

[30] Foreign Application Priority Data

Dec. 26, 1996 [JP] Japan ..... 8-357136

[51] Int. Cl.[6] ..... B65D 85/00; B65D 19/00

[52] U.S. Cl. ..... 206/711; 206/386; 206/586; 206/589; 206/600; 220/6

[58] Field of Search ..... 206/386, 586, 206/587, 588, 589, 600, 454, 707, 711, 722, 723, 725; 220/4.31, 6

[56] References Cited

U.S. PATENT DOCUMENTS

| | | | |
|---|---|---|---|
| 4,478,331 | 10/1984 | Ruin | 206/707 |
| 4,767,002 | 8/1988 | Malcolm | 206/707 |
| 5,161,709 | 11/1992 | Oestreich, Jr. | 220/6 |
| 5,501,353 | 3/1996 | Warren | 220/6 |
| 5,738,219 | 4/1998 | Arsena et al. | 206/723 |

FOREIGN PATENT DOCUMENTS

| | | | |
|---|---|---|---|
| 002673910 | 9/1992 | France | 206/600 |
| 56-27062 | 6/1981 | Japan . | |

*Primary Examiner*—Paul T. Sewell
*Assistant Examiner*—Jila Mohandesi
*Attorney, Agent, or Firm*—Armstrong, Westerman, Hattori, McLeland & Naughton

[57] ABSTRACT

A container 2 comprising: a fixed side plate 10 placed upward on a pallet 4 so as to envelope at least three directions, a first pivotal side plate 12 mounted on an upper end of the fixed side plate 10 detachably and pivotally toward the inside of the container 2, a second side plate 24 mounted on an upper end of the first pivotal side plate 12 pivotally toward the outside of the container 2. The container 2 preferably further comprises; pivotal projections 14 provided on both sides of lower end of the first pivotal side plate 12, a frame member 8 for holding both sides of the fixed side plate 10, which has a vertical groove 18 for accepting the pivotal projection 14 to be inserted and a horizontal groove 20 formed under the vertical groove 18 for holding the pivotal projection 14 in order to lock the pivotal projection 14 from being pulled out upward. The container is easy to take out the goods, is able to be made smaller by folding up the container when the container is returned and is able to return the members for protecting the goods contained in the container.

9 Claims, 5 Drawing Sheets

CONTAINER

BACKGROUND OF THE INVENTION

1. Field of the Invention

The present invention relates to a container, more particularly, a container for transporting flat electronic parts which are used for producing, for example, a variety of flat panels, display devices (plasma display devices, liquid crystal display devices, and so on), and the like.

2. Description of the Related Art

Assemblage type containers are known as disclosed in Utility Model Examined Publication No. 56-27062. The container disclosed in this publication is easy to assemble and dismantle and is convenient for handling, because it is possible to make the bulk of the container smaller by dismantling it, when only the container is returned after transporting the goods in the container.

In the case of transporting flat electronic parts, for example, glass substrates for defining display surfaces of plasma display devices, in the container disclosed in the publication, however, a lot of protecting cases or shock absorbers are necessary to be arranged, because these flat electronic parts are easy to be destroyed. The container itself is easy to be returned, because the container is dismantled and the bulk of the container is made smaller after transporting the flat electronic part, however, the treatment of the protecting cases or shock absorbers is a problem. It is not preferable to dump the protecting cases or shock absorbers at the transporting destination, because it wastes resources and produces a lot of refuse.

Therefor, it is required to return the protecting cases and shock absorbers with the container and reutilize them; however, conventional containers do not have a suitable construction to return the protecting cases and shock absorbers with the container.

Further, the conventional container has a problem that the height of the side plates of the container is more than the height of flat electronic parts so that the side plates interfere with the electronic parts and protecting cases to be taken out and the working efficiency is not good, when the electronic parts are taken out from the container.

SUMMARY OF THE INVENTION

In view of the foregoing, the object of the present invention is to provide a container which is preferably used for transporting goods, for example flat electronic parts which are easy to be destroyed. The container makes it easy to take out the good, is able to be made smaller by folding up the container when the container is returned; and is able to return the members for protecting the goods contained in the container.

To achieve the above-mentioned object, a container for transporting goods of the present invention comprises:

a fixed side plate placed upward on a pallet so as to envelope at least three directions, a first pivotal side plate mounted on an upper end of said fixed side plate detachably and pivotally toward the inside of said container, a second pivotal side plate mounted on an upper end of said first pivotal side plate pivotally toward the outside of said container.

The means for mounting said first pivotal side plate on the upper end of said fixed side plate detachably and pivotally toward the inside of the container preferably comprises:

a pivotal projection provided on a lower end of said first pivotal side plate, a frame member for holding both sides of said fixed side plate, which has a vertical groove for accepting said pivotal projection to be inserted and a horizontal groove formed under the vertical groove for holding said pivotal projection in order to lock said pivotal projection from being pulled out upward.

The container preferably further comprises a movable side plate which is dividable vertically into at least two pieces having horizontal split lines and is attached detachably to the side ends of the fixed side plate.

The fixed side plate enveloping three directions is preferably comprised of three fixed side plates.

Preferably, the goods, for example flat electronic parts, are attached to the protecting case and are contained in the container with the protecting case. However, in accordance with the present invention, the goods without the protecting case may be contained in the container.

Preferably, a lower shock absorber member supporting the bottom ends of goods or protecting cases in predetermined distances is attached in the bottom surface of the container.

Preferably a side shock absorber member supporting the side ends of goods or protecting cases in predetermined distances is attached detachably inside said fixed side plate.

The container is preferably provided with a lid member. The lid member is preferably provided with an upper shock absorber member supporting the upper ends of goods or the protecting cases in predetermined distances. The lid member is attached on the second side plate in a state that the goods are contained in the container with or without the protecting cases so that the lid member envelopes the inside of the container. The lid member is also able to be attached on the fixed side plate in a state that the first pivotal side plate is pivoted inwardly with the second pivotal side plate.

In accordance with the container, the goods, such as flat electronic parts, are put in the container in a state that the second pivotal side plate is pivoted outwardly against the first pivotal side plate. Thereafter, the second pivotal side plate is pivoted as it was before, so that the goods are accepted fully in the container. The loading operation of the goods is finished by attaching the lid member on the container. Accordingly, the loading operation is easy, even if the goods have the same height as the depth of the container and are easy to be destroyed.

When the goods are taken out from the container at the transport destination, the lid member is removed and thereafter the second pivotal side plate is pivoted outwardly against the first pivotal side plate, so that the goods are taken out. Therefore, the goods are easily taken out from the container without interfering with the side plates, not as with the conventional container, even if the goods have the same height as the depth of the container and are easy to be destroyed.

When the container, after taking out the goods, is returned for utilizing repeatedly, protecting cases for protecting the goods and the shock absorber members are piled up in the container and the first pivotal side plate is pivoted inwardly with the second pivotal side plate against the fixed side plate so as to fold up them. As a result, the bulk of the container is made smaller than that of the container accommodating the goods and smaller space is needed than before. In the container, of which the bulk is made smaller, the protecting cases and the shock absorber members are just fitted so that the container can be returned to the original place from which the container is transported, without preparing the other containers or the like, to return the protecting cases and the shock absorber members to the original place.

The protecting cases and the shock absorber members which are returned can be utilized repeatedly. Consequently, the present invention contributes the reduction of waste and to the utilization of resources.

BRIEF DESCRIPTION OF THE DRAWINGS

Other objects and features of the present invention will be described in detail with reference to accompanying drawings, in which.

DESCRIPTION OF THE PREFERRED EMBODIMENTS

Figure 1:
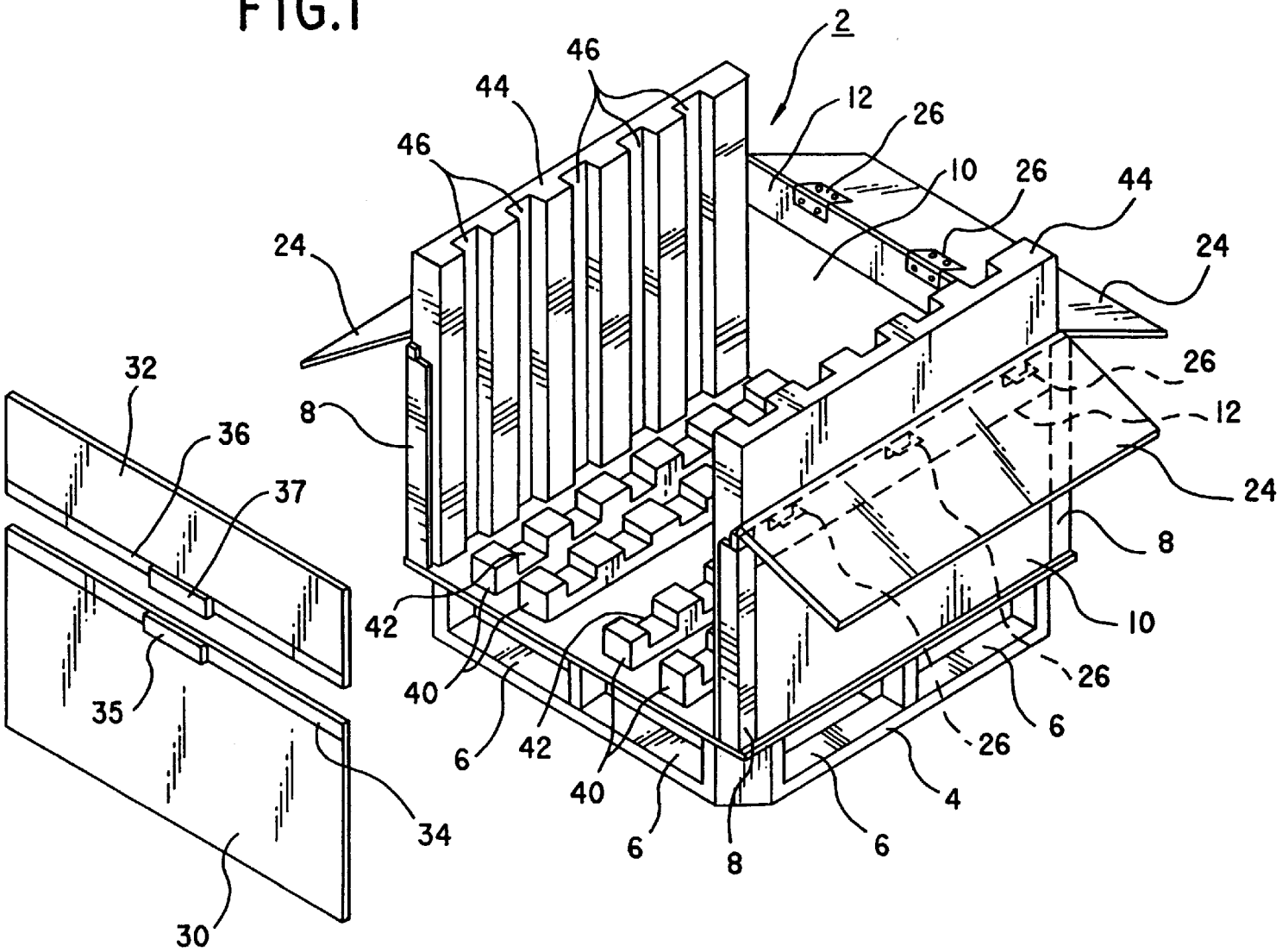
FIG. 1 is a partial exploded perspective view of a container of an embodiment of the present invention.

As shown in FIG. 1, the container 2 of the embodiment has a pallet 4. The pallet 4 is provided with lifting holes 6 to which rail portions of a fork lift are inserted. The pallet 4 is preferably comprised of a metal, such as stainless steel, but may be comprised of a material which is not a metal, such as plastics.

On each of the four corners of the pallet 4, a frame member 8 having an L-shaped cross section is provided upwardly by welding. The frame members 8 are preferably comprised of metal, like the pallet, but may be comprised of different materials.

Fixed side plates 10 are fixed between the frame members 8 on the pallet 4 to cover three sides of the four sides of the pallet 4. The fixed side plates 10 are preferably comprised of plastic plate, fiber reinforced plastic plate or the like, but may be comprised of other materials.

On the upper ends of the fixed side plates 10, first pivotal side plates 12 are respectively mounted detachably and are pivotal toward the inside of the container 2. The details of the mounting portion between the first pivotal side plate 12 and the fixed side plate 10 are shown in FIG. 3.

Figure 3:
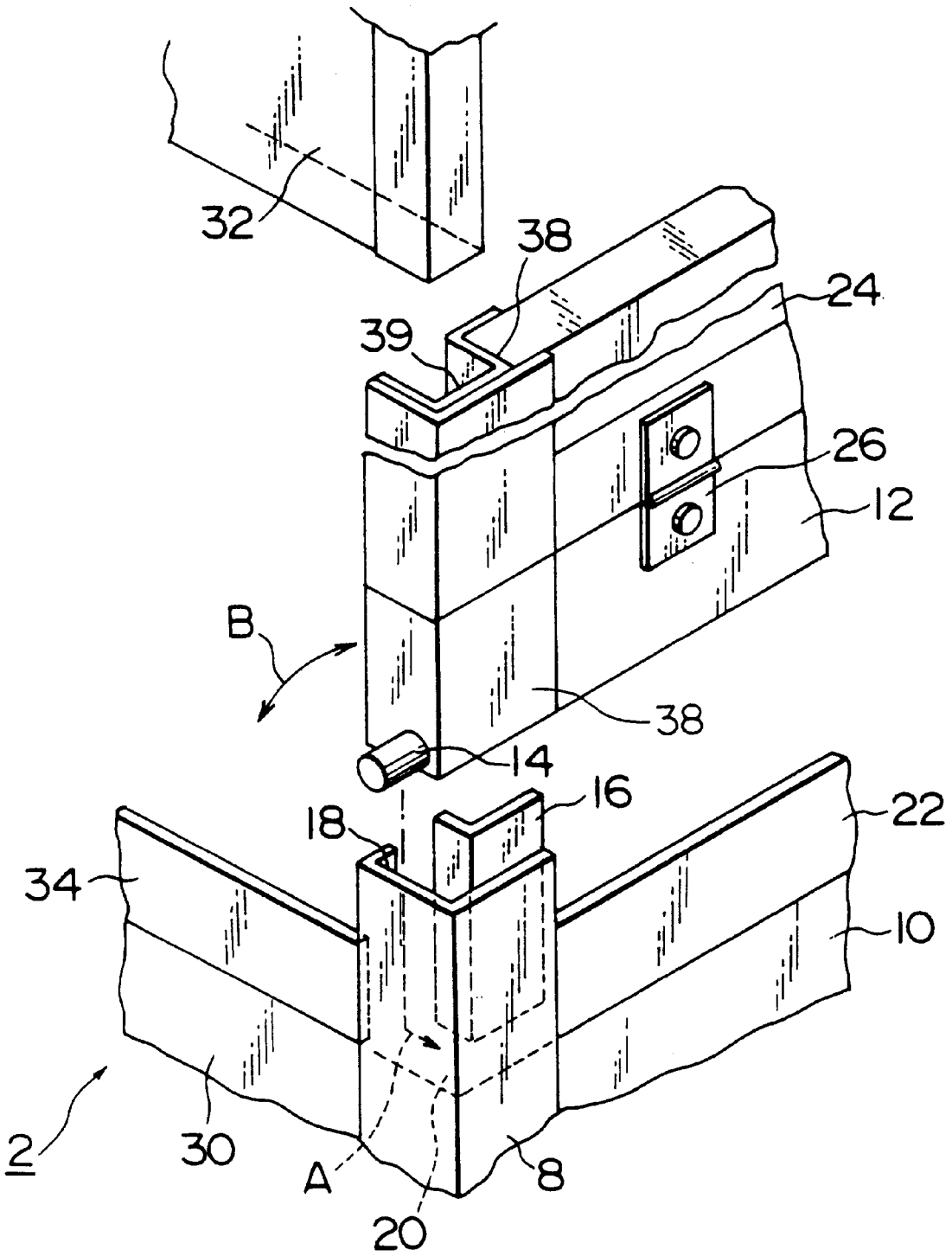
FIG. 3 is an exploded perspective view showing a detail of an attaching portion of a first pivotal side plate and a fixed side plate.

As shown in FIG. 3, pivotal projections 14 are fixed on the both sides of lower end of the first pivotal side plate 12. Further, engagement pieces 16 having L-shaped cross sections are fixed to the frame member 8 for holding the both sides of the fixed plate 10, so as to define vertical grooves 18 extending along the longitudinal direction of the frame members 8 and a horizontal groove 20 extending in the horizontal direction to communicate with the vertical grooves 18.

The pivotal projection 14 of the first pivotal side plate 12 is inserted along the vertical groove 18 of the frame member 8 and is moved horizontally (arrow "A" in the FIG. 3) at the lower end of the groove 18, so that each pivotal projection 14 is locked by the adjacent engagement piece 16 to be prevented from being pulled out upwardly. Accordingly, the first pivotal side plate 12 is prevented from being pulled out upwardly so that the first pivotal side plate 12 is permitted to pivot toward the inside of the container 2 (arrow "B" in the FIG. 3). The pivotal movement of the first pivotal side plate 12 toward the outside of the container is restricted, because the first pivotal side plate 12 collides with a fitting belt 22 and the frame member 8.

On each of the upper ends of these first pivotal side plates 12, second pivotal side plates 24 are respectively attached and are pivotable pivotally only toward the outside of the container by means of hinges 26. The second pivotal side plates 24 are preferably comprised of plastic plates or fiber reinforced plastic plates like the first pivotal side plates, but may be comprised of other materials.

Figure 4:
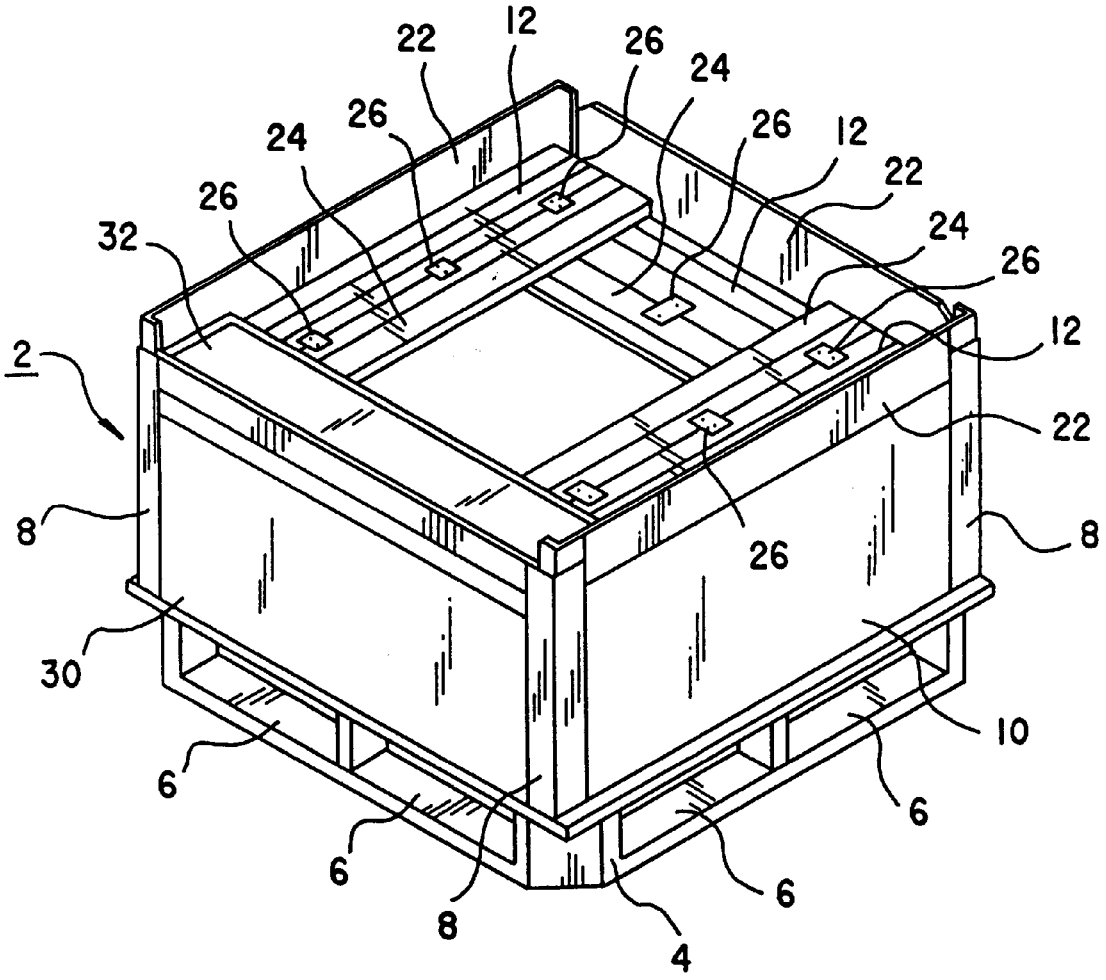
FIG. 4 is a perspective view showing the folded container when the container is returned.

Since the second pivotal side plates 24 are attached to the first to be pivotable side plates 12 pivotally only toward the outside of the container, the second pivotal side plates 24 are fold up inside the container with the first pivotal side plates 12, .when the first pivotal side plates 12 are pivoted inwardly of the container and folded up as shown in FIG. 4. Note that vertical widths (heights) of the second pivotal side plates 24 are preferably designed to be wider than that of the first pivotal side plates. The second pivotal side plates 24 to have predetermined vertical widths so that the second pivotal side plates 24 are pivoted outward to make it easier to insert the goods into the container and to take out the goods from the container as shown in FIG. 1.

As shown in FIG. 1, movable side plates 30 and 32 which are dividable vertically into two pieces having horizontal split lines are attached removably to the portion where no fixed side plate is located on the pallet. The lower movable side plate 30 has substantially the same height (vertical width) as the fixed side plate 10 and the upper movable side plate 32 has substantially the same height as the added up heights of the first pivotal side plate 12 and second pivotal side plate 24.

These movable side plates 30 and 32 are respectively provided with fitting belts 34 and 36 on the connecting portions. An insertion hole 35 and an insertion projection 37 are respectively attached to the centers of the fitting belts so that the projection is able to be fitted into the hole.

As shown in FIG. 3, fitting members 38 are attached along the vertical direction to the side ends of the first pivotal side plate 12 and second pivotal side plate 24 on the side where the upper movable side plate 32 is attached. The fitting members 38 are provided with grooves 39 for insertion of the side end of the upper movable side plate 32. Further, the aforementioned pivotal projection 14 is formed on the fitting member 38.

As shown in FIG. 1, lower shock absorber members 40 are arranged on the bottom of the container 2. The lower shock absorber members are provided with supporting grooves in predetermined distances along the longitudinal direction.

Figure 2:
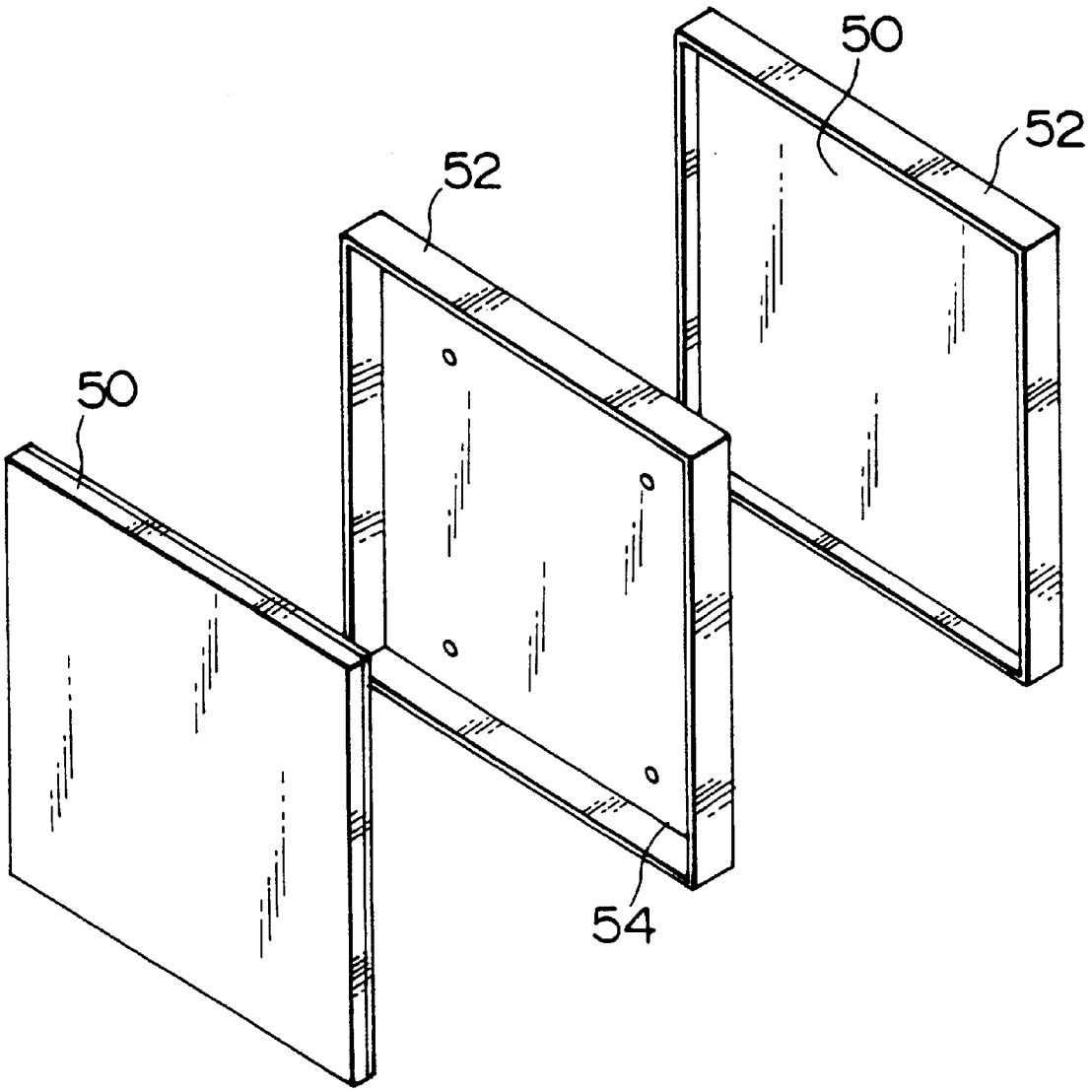
FIG. 2 is a perspective view showing a relationship between protecting cases and flat electronic parts.

As shown in FIG. 1, lower shock absorber members 40 are attached on the bottom of the container 2. The lower shock absorber members 40 are provided with supporting grooves 42 in predetermined distances along the longitudinal direction thereof. Each supporting groove 42 receives the lower end of protecting cases 52 for protecting glass substrate of plasma display device shown in FIG. 2. Since the glass substrates 50 are easy to be destroyed, each glass substrate 50 is held by the protecting case 52 having a rectangular recessed portion 54 as shown in FIG. 2. In this state, each glass substrate 50 with the protecting case 52 is contained in the container shown in FIG. 1. Note that the lower shock absorber members 40 are comprised of, for example, plastics and the protecting cases 52 are comprised of metals, reinforced plastics, or the like.

As shown in FIG. 1, side shock absorber members 44 are attached detachably inside the fixed side plates 10 and 10 which are placed in opposite side of the container 2. The side shock absorber members 44 are provided with holding grooves 46 on the predetermined spacing. The distances between the holding grooves 46 are substantially the same as the distances between the supporting grooves 42 formed on the lower shock absorber members 40. The side shock absorber members 44 are comprised of, for example plastic form. The height of the side shock absorber member 44 is not more than the height which is obtained by adding up the height of the fixed side plate 10 and the vertical widths (heights) of the first pivotal side plate 12 and the second pivotal side plate 24. As shown in FIG. 1, the side shock absorber members 44 are projecting upward from the first pivotal side plates 12, when the second pivotal side plates 24 are pivoted outwardly.

Figure 5:
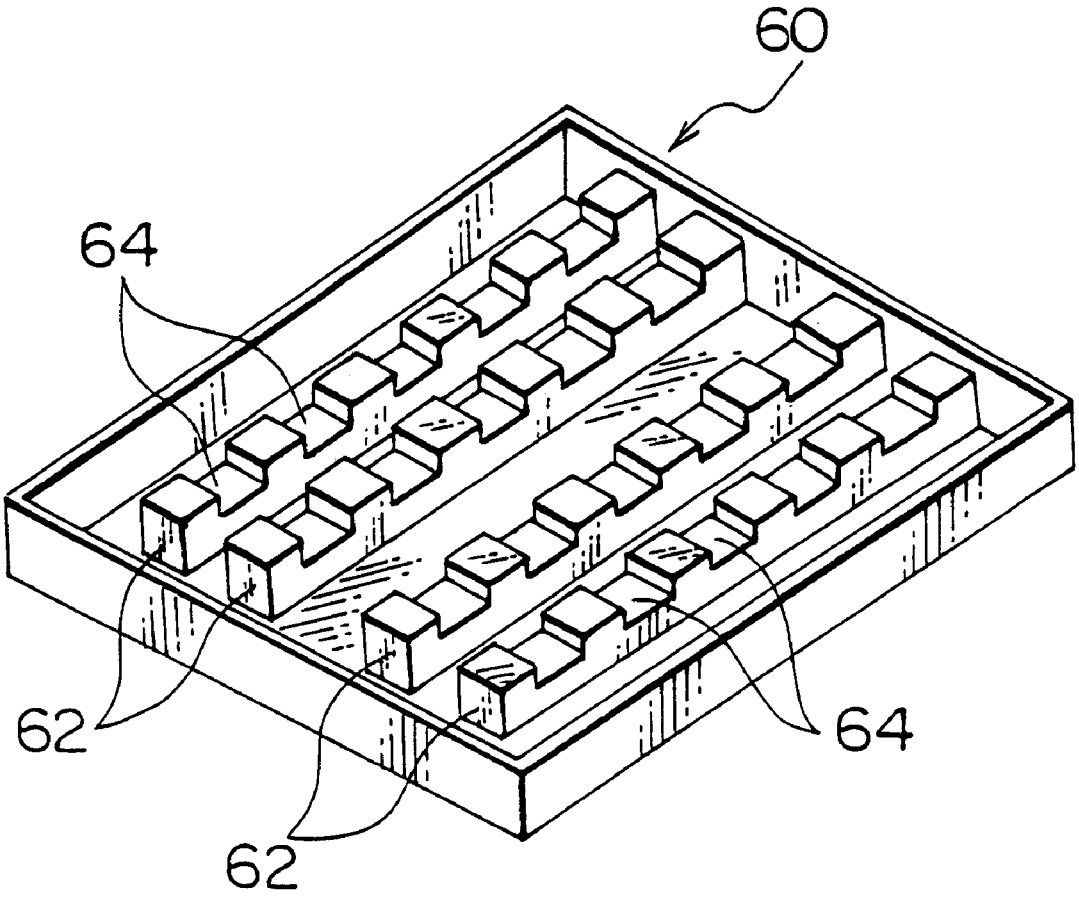
FIG. 5 is a perspective view showing a back surface of a lid member.

Note that a lid member 60 shown in FIG. 5 is able to be cover the container 2 of the present embodiment. The back surface of the lid member 60 is provided with upper shock absorber members 62 holding the upper ends of the protecting cases 52 shown in FIG. 2. The upper shock absorber members 62 attached on the back surface of the lid member 60 have the same construction and are comprised of the same materials as the lower shock absorber members 40 shown in FIG. 1. Supporting grooves 64 of the upper shock absorber members 62 correspond to the supporting grooves 42 of the lower shock absorber members 40.

The lid member 60 is able to be attached on the second pivotal side plates 24 in order to cover the inside of the container 2, when the second pivotal side plates 24 are pivoted vertically and the glass substrates 50 with protecting cases 52 are contained in the container 2. The lid member 60 is also able to be attached on the container, when the first pivotal side plates 12 are pivoted inward as shown in FIG. 4.

In accordance with the container 2 of the present embodiment, the goods, such as glass substrates 50, are put in the container when the movable side plates 30 and 32 are removed from the container and the second pivotal side plates 24 are pivoted outwardly against the first pivotal side plates. Thereafter, the second pivotal side plates 24 are pivoted as it was before (pivoted vertically) and the movable side plates 30 and 32 are attached to the container, so that the goods are accepted fully in the container 2. The loading operation of the goods is finished by attaching the lid member 60 on the container. Accordingly, the loading operation is easy, even if the goods have substantially the same height as the depth of the container and are easy to be destroyed, like glass substrates 50.

When the goods are taken out from the container at the transport destination, the lid member is removed, the movable side plates 30 and 32 are removed and thereafter the second pivotal side plates 24 are pivoted outwardly against the first pivotal side plates 12, so that the goods are taken out. Therefore, the goods are easily taken out from the container without interfering with the side plates not like the conventional container, even if the goods have substantially the same height as the depth of the container and are easy to be destroyed like glass substrates 50.

When the container 2, after taking out the goods, is returned for utilizing repeatedly, the vacant protecting cases 52 for protecting the goods and the shock absorber members 44 are piled up in the container 2 and the first pivotal side plates 12 are pivoted inwardly with the second pivotal side plates 24 against the fixed side plates so as to fold up them. Note that the lower movable side plate 30 is left as it was and only the upper movable side plate 32 is removed to be put on the folded pivotal side plates 12 and 24. Thereafter, the lid member is attached to cover the container.

As a result, the bulk of the container 2 is made smaller than that of the container accommodating the goods and smaller space is needed than before. In the container 2, of which the bulk is made smaller, the vacant protecting cases 52 and the shock absorber members 44 are just fitted so that the container can be returned to the original place from which the container is transported, without preparing other containers, and the like, to return the protecting cases 52 and the shock absorber members 44 to the original place.

The protecting cases 52 and the shock absorber members 44, which are returned can be utilized repeatedly. Consequently, the invention contributes to the reduction of waste and to the utilization of resources.

Note that the present invention is not restricted to the above-mentioned embodiment and may be modified in a variety of modes within the spirit of the present invention.

For example, in the above-mentioned embodiment, the glass substrates 50 are exemplified as the goods contained in the container 2, however, the goods in the container 2 are not restricted to the glass substrates, but may be another flat electronic parts, or other goods.

As mentioned above, in accordance with the container of the present invention, the loading and unloading operations are very easy, even if the goods have substantially the same height as the depth of the container and are easy to be destroyed, like flat electronic devices.

We claim:

1. A container for transporting goods comprising a pallet, a plurality of rectangularly disposed frame members extending from said pallet, a plurality of fixed side plates extending upwardly from said pallet to envelop at least three sides of said container and being held by said frame members, said fixed side plates each having a first pivotal plate detachably mounted on an upper end of said fixed side plate, a pivot projection provided at opposite lower ends of said first pivotal plate and engaging said frame members to render said first pivotal plate pivotable toward the inside of said container, and a second pivotal plate pivotally connected to an upper end of said first pivotal plate and pivotable toward the outside of said container.

2. The container as set forth in claim 1 wherein said frame members each contain means forming a vertical groove for accepting said pivot projection and a horizontal groove formed under, and communicating with, said vertical groove for preventing said pivot projection from being pulled upwardly.

3. The container as set forth in claim 1, further comprising a movable side plate which is dividable vertically into at least two pieces having horizontal split lines and is mounted detachably to the side ends of the fixed side plate.

4. The container as set forth in claim 1 including means for attaching goods to a protecting case and for containing the protecting case in the container.

5. The container as set forth in claim 4, including a lower shock absorber member supporting the bottom ends of protecting cases on predetermined spacing attached to the bottom surface of the container.

6. The container as set forth in claim 4, including a side shock absorber member supporting the side ends of protecting cases on predetermined spacing attached detachably inside and fixed side plates.

7. The container as set forth in claim 1, further comprising a lid member.

8. The container as set forth in claim 7, wherein the lid member is attached on said second pivotal plates in a state that the goods are contained in the container so that the lid member envelopes the inside of the container and the lid member is also able to be attached on the fixed side plate in a state that said first pivotal plates are pivoted inwardly with said second pivotal plate.

9. The container as set forth in claim 7, wherein the lid member is provided with an upper shock absorber member.

* * * * *